US006598707B2

(12) United States Patent
Nakagaki et al.

(10) Patent No.: US 6,598,707 B2
(45) Date of Patent: Jul. 29, 2003

(54) ELEVATOR

(75) Inventors: Shigeo Nakagaki, Fuchu (JP); Kazuo Shimane, Fuchu (JP); Kazuaki Miyakoshi, Fuchu (JP); Masaru Tateyama, Fuchu (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 57 days.

(21) Appl. No.: 09/994,836

(22) Filed: Nov. 28, 2001

(65) Prior Publication Data

US 2002/0070080 A1 Jun. 13, 2002

(30) Foreign Application Priority Data

Nov. 29, 2000 (JP) ..... 2000-362598

(51) Int. Cl.[7] ..... B66B 11/08
(52) U.S. Cl. ..... 187/256; 187/254; 187/266
(58) Field of Search ..... 187/251, 254, 187/256, 266

(56) References Cited

U.S. PATENT DOCUMENTS 5,899,300 A * 5/1999 Miller et al. ..... 187/256
6,247,557 B1 * 6/2001 Kobayashi et al. ..... 187/266
6,302,239 B1 * 10/2001 Honda ..... 187/254
6,471,012 B2 * 10/2002 Faletto ..... 187/256
6,488,124 B1 * 12/2002 Yasuda et al. ..... 187/254
2002/0017434 A1 * 2/2002 Orrman et al. ..... 187/254

FOREIGN PATENT DOCUMENTS

JP 11-157762 6/1999

* cited by examiner

*Primary Examiner*—Christopher P. Ellis
*Assistant Examiner*—Thuy V. Tran
(74) *Attorney, Agent, or Firm*—Finnegan, Henderson, Farabow, Garrett & Dunner, L.L.P.

(57) ABSTRACT

An elevator installed in an elevator shaft has a cage, a counterweight, hoist cables suspending the cage and the counterweight, and a driving unit disposed outside a space in which the cage moves vertically in the elevator shaft, and provided with drive sheaves around which the hoist cables are wound to move the cage and the counterweight in the elevator shaft by the driving unit. The hoist cables are wound around the drive sheaves and sheaves supported on the cage and the counterweight in two-to-one roping arrangement such that the driving unit is at a level below the ceiling of the cage as located at its uppermost position. The cage-side sheaves are disposed at four positions on the lower portion of the cage respectively and symmetrically with respect to a center of gravity of the cage in a top plan view.

4 Claims, 7 Drawing Sheets

ELEVATOR

BACKGROUND OF THE INVENTION

1. Field of the Invention

The present invention relates to an elevator having no machine room disposed above an elevator shaft and, more specifically to an improved elevator capable of reducing the vertical height of a top space of the elevator shaft and of stably suspending an elevator cage.

2. Description of Related Art

Various elevators having no machine room disposed above an elevator shaft have been developed and proposed for the efficient utilization of space in buildings and for observing regulations regarding a right to sunshine.

FIGS. 6 and 7 show an elevator 1 previously proposed by the applicant of the present patent application in JP-A 157762/1999. This elevator 1 was developed to reduce the height of the top space of the elevator shaft and to reduce the horizontal cross section of the elevator shaft.

In this elevator 1, a pair of connecting beams 6 is horizontally extending between the upper ends of a pair of cage guide rails 3 for guiding the vertical movement of an elevator cage 2 and the upper ends of a pair of counterweight guide rails 5 for guiding a vertical movement of a counterweight 4 respectively. A drive unit 9 is mounted on a support beam 8 that extends horizontally between the upper ends of a pair of counterweight guide rails 5, in the vicinity of the inner side surface 7*a* of an elevator shaft 7.

A pair of drive shafts 11R and 11L projects from a hoist 10 included in the drive unit 9. A pair of traction sheaves 12R and 12L are mounted on the pair of drive shafts 11R and 11L, respectively. A pair of hoist cables 13R and 13L are wound around the pair of traction sheaves 12R and 12L, respectively.

One ends of the pair of hoist cables 13R and 13L are hitched directly to the elevator cage 2 by means of hitching devices 14, and the other ends are hitched directly to the counterweight 4 by means of hitching devices 15.

Referring to FIG. 7 which shows a top plan view of the elevator 1, the traction sheaves 12R and 12L are disposed in a space between the right inner side surface 7R of the elevator shaft 7 and the right vertical outer side wall 2R of the elevator cage 2, and a space between the left inner side surface 7L of the elevator shaft 7 and the left vertical outer side wall 2L of the elevator cage 2, respectively.

Therefore, the traction sheaves 12R and 12L do not interfere with the elevator cage 2 when the elevator cage 2 exists at the top portion of the elevator shaft 7. Consequently, the vertical height of the top space and the horizontal cross section of the elevator shaft 7 can be reduced.

However, in this elevator 1, the elevator cage 2 and the counterweight 4 are suspended by the pair of hoist cables 13R and 13L extending in so-called one-to-one roping arrangement, which is hitched directly to the elevator cage 2 and the counterweight 4 respectively.

Therefore, the hoist 10 must be capable of exerting a large torque and hence the hoist 10 has a comparatively big diameter.

Also the drive unit 9 including the hoist 10 mounted on the support beam 8 has a comparatively big diameter, there is still some room for reducing the vertical height of the top space of the elevator shaft 7.

Further, the one end of the hoist cables 13R and 13L are secured to the elevator cage on the side of the counterweight 4 with respect to the center of gravity G of the elevator cage 2, as shown in FIG. 6.

Thus, there is still some room for improving the method of suspending the cage 2 for more stable suspension.

Since the traction pulleys 12R and 12L are on the outer side of the vertical side walls 2R and 2L of the cage 2, respectively, as shown in FIG. 7, an extension shaft 17 needs to be connected to the drive shaft 11R by a coupling 16 when the cage 2 has a big width, which increases the number of parts of the elevator.

SUMMARY OF THE INVENTION

Accordingly, it is an object of the present invention to solve those problems in the prior art and to provide an elevator capable of further reducing the vertical height of a top space of an elevator shaft, of further stably suspending a cage, and comprising a reduced number of component parts.

According to a first aspect of the present invention, an elevator includes: a cage capable of vertically moving along cage guide rails in an elevator shaft, and provided on lower surface of its floor with cage-side sheaves; a counterweight capable of vertically moving along counterweight guide rails in the elevator shaft and provided with counterweight-side sheaves; two hoist cables extended in two-to-one roping arrangement around the cage-side sheaves and the counterweight-side sheaves such that one end part of each hoist cable suspends the cage and the other end part of the same suspends the counterweight; and a driving unit including traction sheaves around which the two hoist cables are wound, respectively, and held on upper ends of the counterweight guide rails.

The traction sheaves of the driving unit are disposed in a space between a side surface of the elevator shaft, facing the counterweight and a vertical side surface of the cage facing the same side surface of the elevator shaft when the cage is located at its uppermost position in the elevator shaft.

Since the cage and the counterweight are suspended by the hoist cables extended in two-to-one roping arrangement in the elevator in the first aspect of the present invention, the output torque of the driving unit, as compared with that of a driving unit for an equivalent elevator in which a cage and a counterweight are suspended in one-to-one roping arrangement, may be low and hence the driving unit may be of small dimensions.

Thus, the driving unit can be supported on the upper ends of the counterweight guide rails so that the traction sheaves are in the space between the side surface facing the counterweight of the elevator shaft and the vertical side wall facing the same side surface of the elevator shaft of the cage when the cage of the elevator is located at its uppermost position.

Since the driving unit and the cage do not lie on top of each other, the height of the top space of the elevator shaft may be small.

Since the driving unit and the cage do not lie on top of each other, the height of the top space of the elevator shaft may be small. Since the hoist cables are extended around the cage-side sheaves and the counterweight-side sheaves in two-to-one roping arrangement to suspend the cage and the counterweight, the driving unit can be disposed at a level below that of the ceiling of the cage as located at its uppermost position, so that height of the top space of the elevator shaft may be small.

When the hoist cables are thus extended around the sheaves in two-to-one roping arrangement, the respective moving speeds of the cage and the counterweight are half the winding speed of the traction sheaves; that is, the ratio of the winding speed to the moving speed of the cage and the counterweight is 2 to 1.

In the elevator according to the present invention, the four cage-side sheaves may be disposed respectively at four positions on the lower surface of the floor of the cage, arranged symmetrically with respect to a vertical line passing the center of gravity of the cage, and the two hoist cables wound respectively around the two traction sheaves may be wound around the two cage-side sheaves and around the other two cage-side sheaves, respectively, in two-to-one roping arrangement to support the cage.

In the elevator according to the present invention, the four cage-side sheaves may be disposed respectively at four positions on the lower portion of the cage, arranged symmetrically with respect to a center of gravity of the cage, and the two hoist cables wound respectively around the two traction sheaves may be wound around the two cage-side sheaves and around the other two cage-side sheaves, respectively, in two-to-one roping arrangement to support the cage. Thus, the gravity force and the lifting force both acting on the cage are aligned substantially and hence the cage can be stably suspended.

The center of gravity of the cage in this specification signifies a assumed point on which the gravity force acts when the cage is vacant.

If the cage is designed such that the center of gravity of the cage exists in a rectangle defined by the four cage-side sheaves disposed at the four corners of the cage respectively in top plan view, an offset between the gravity force and the lifting forth both acting on the cage and that is not large and hence the cage can be stably suspended.

Thus, it is preferable to dispose the four cage-side sheaves in the four corners of the floor of the cage, respectively.

In the elevator according to the present invention, ends on the side of the cage of the hoist cables may be connected to a cage-side hitching beam supported on one of the cage guide rails, at positions symmetrical with respect to the cage guide rail which supports the cage-side hitching beam.

Since the hoist cables are extended symmetrically with respect to the cage guide rails and are hitched to the cage-side hitching beam held on one of the cage guide rails symmetrically with respect to the same, bending moments exerted upon the cage-side hitching beam by the two hoist cables respectively, the cage guide rail which support the cage-side hitching beam can be prevented from bending.

In the elevator according to the present invention, the ends on the side of the counterweight of the hoist cables may be connected to counterweight-side hitching devices fixed to a cross beam supported by the counterweight guide rails and the cage guide rail on the side of the counterweight.

Load exerted through the hoist cables on the counterweight-side hitching devices is distributed only to the cage guide rail and the counterweight guide rails and is not distributed to a building in which the elevator is installed.

Since the load exerted through the hoist cables on the counterweight-side hitching devices is distributed to the cage guide rail and the counterweight guide rails, the guide rails are prevented from bending or buckling.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 5:
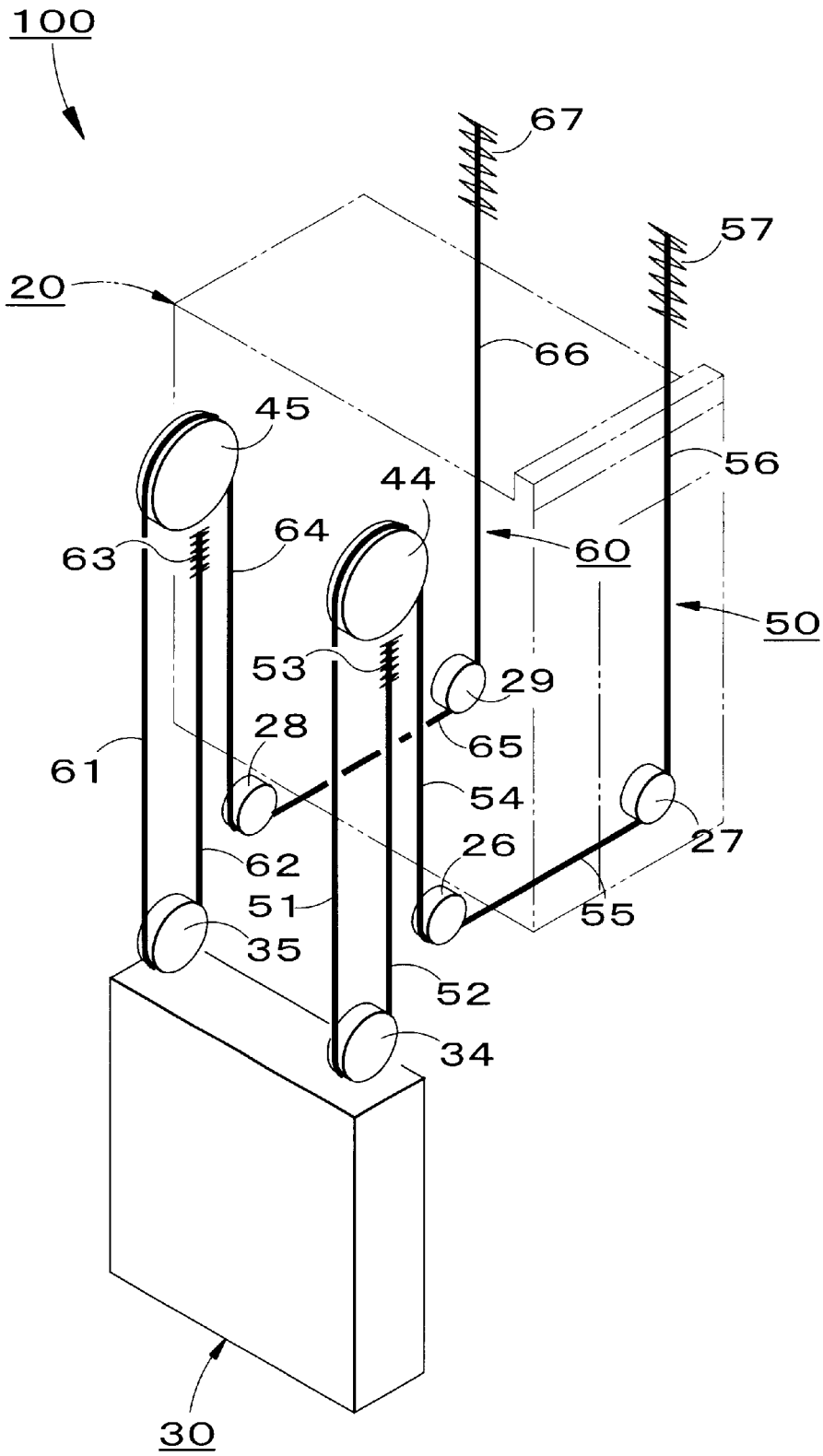
FIG. 5 is a typical perspective view of assistance in explaining a roping method of arranging hoist cables.
Figure 6:
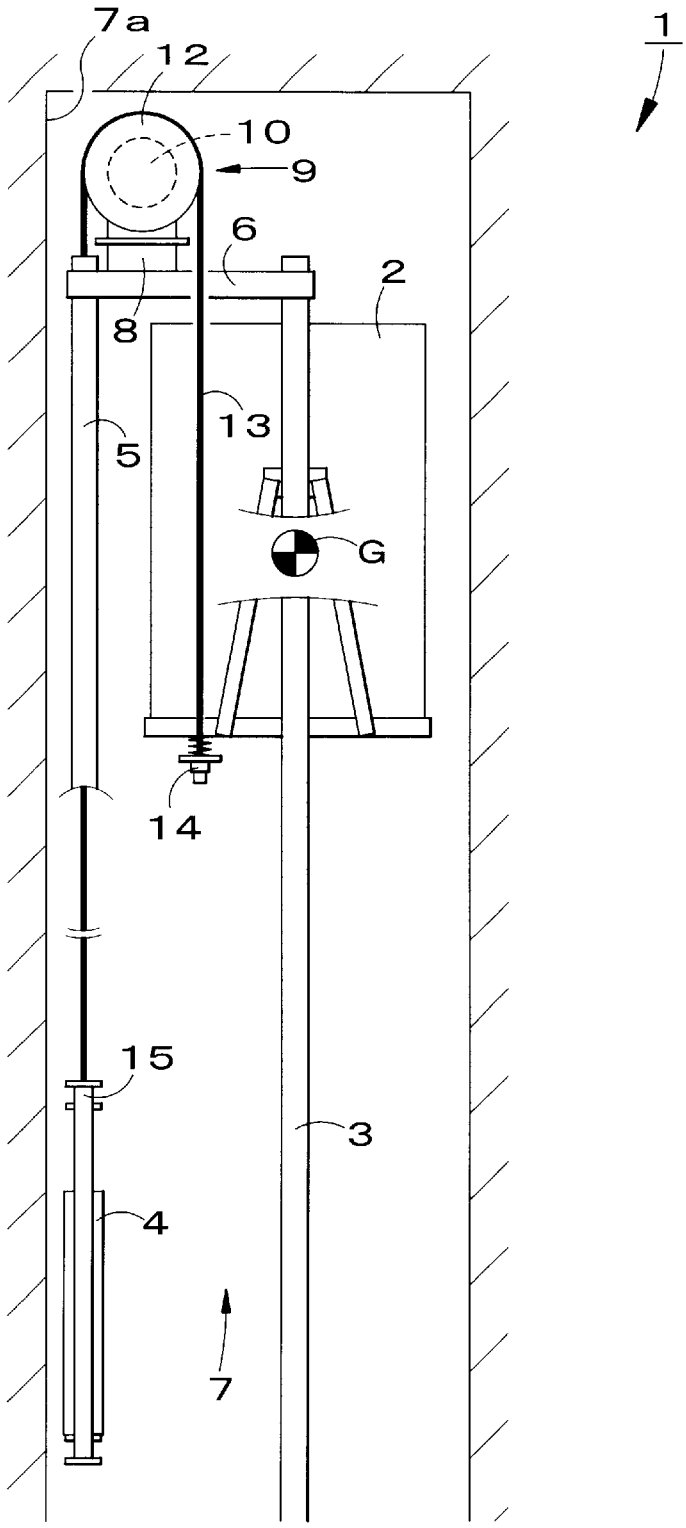
PRIOR ART F I G. 6
FIG. 6 is a schematic side elevation of a prior art elevator.
Figure 7:
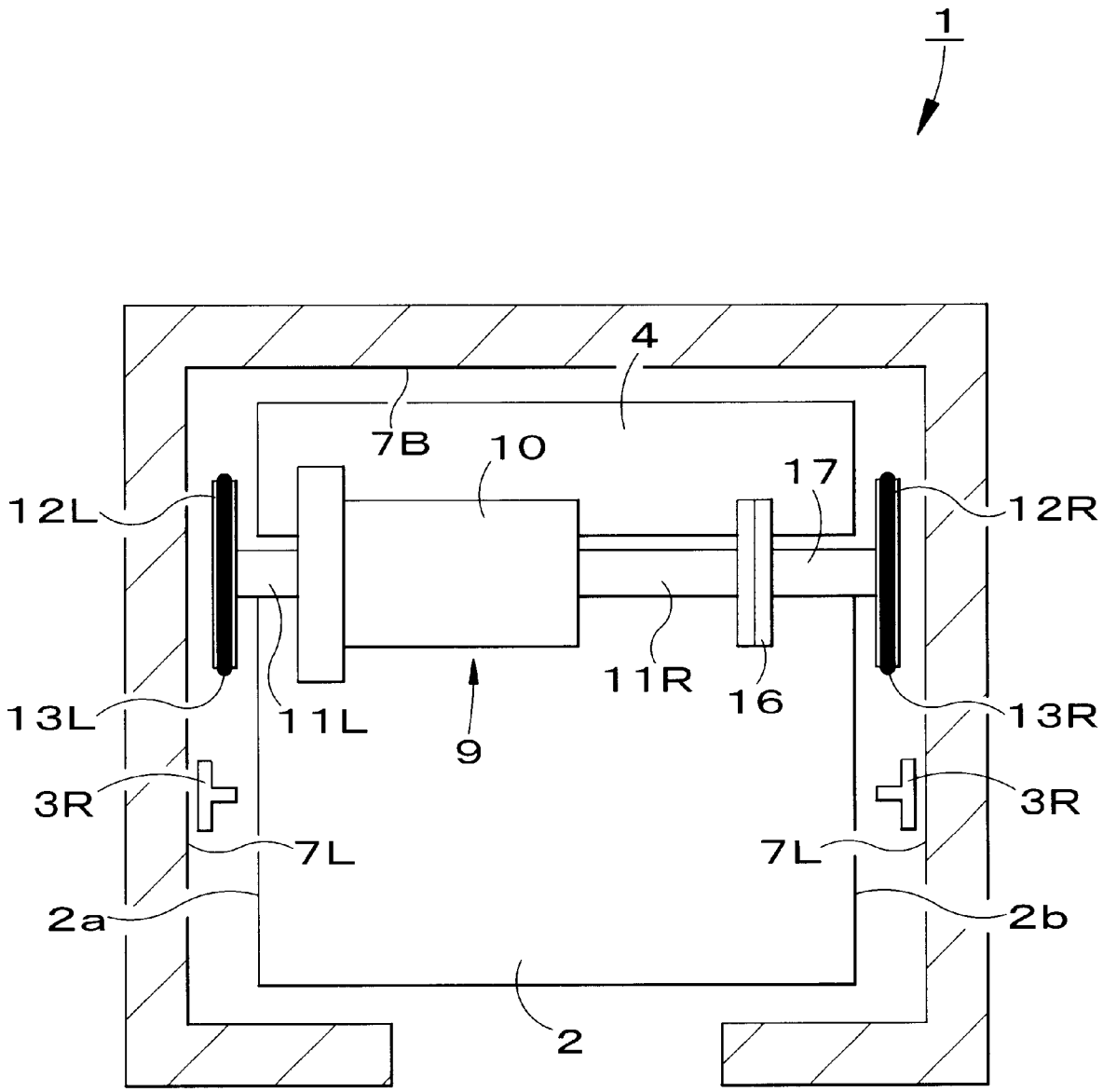
PRIOR ART F I G. 7
FIG. 7 is a schematic plan view of the elevator shown in FIG. 6.

An elevator in a preferred embodiment according to the present invention will be described with reference to FIGS. 1 to 5, in which parts like or corresponding to those of the prior art elevator previously described with reference to FIGS. 6 and 7 are designated by the same reference characters and the description thereof will be omitted.

In the following description, words, front, forward and similar words will be used for characterizing movement, a direction, positions and the like relating to a direction in which passengers walk to leave the cage of the elevator, words, back, backward and analogous words are used for characterizing movement, a direction, positions and the like relating to a direction in which passengers walk to enter the cage of the elevator, words, right, rightward and analogous words will be used for characterizing movement, directions, positions and the like to the right, facing the front side of the cage of the elevator, and words, left, leftward and analogous words will be used for characterizing movement, a direction, positions and the like to the left, facing the front side of the cage of the elevator.

Referring to FIGS. 1 to 5, an elevator 100 in a preferred embodiment according to the present invention has a cage 20 provided on its front side with a door 21 and guided for vertical movement in an elevator shaft 7 by cage guide rails 23 and 22.

The cage guide rails 23 and 22 are disposed on the right and the left side, respectively, of the cage 20. Opposite ends of a connecting beam 24 are connected to the upper ends of the cage guide rails 23 and 22. A cage-side hitching beam 25 is joined to the upper end of the right cage guide rail 23 so as to extend in parallel to the right side wall of the cage 20.

A cage-side hitching beam 25 is joined to the upper end of the right cage guide rail 23 so as to extend in parallel to the right side wall of the cage 20.

Four cage-side sheaves 26, 27, 28 and 29 are supported for rotation on brackets, not shown, on the lower surface of the floor of the cage 20.

Figure 4:
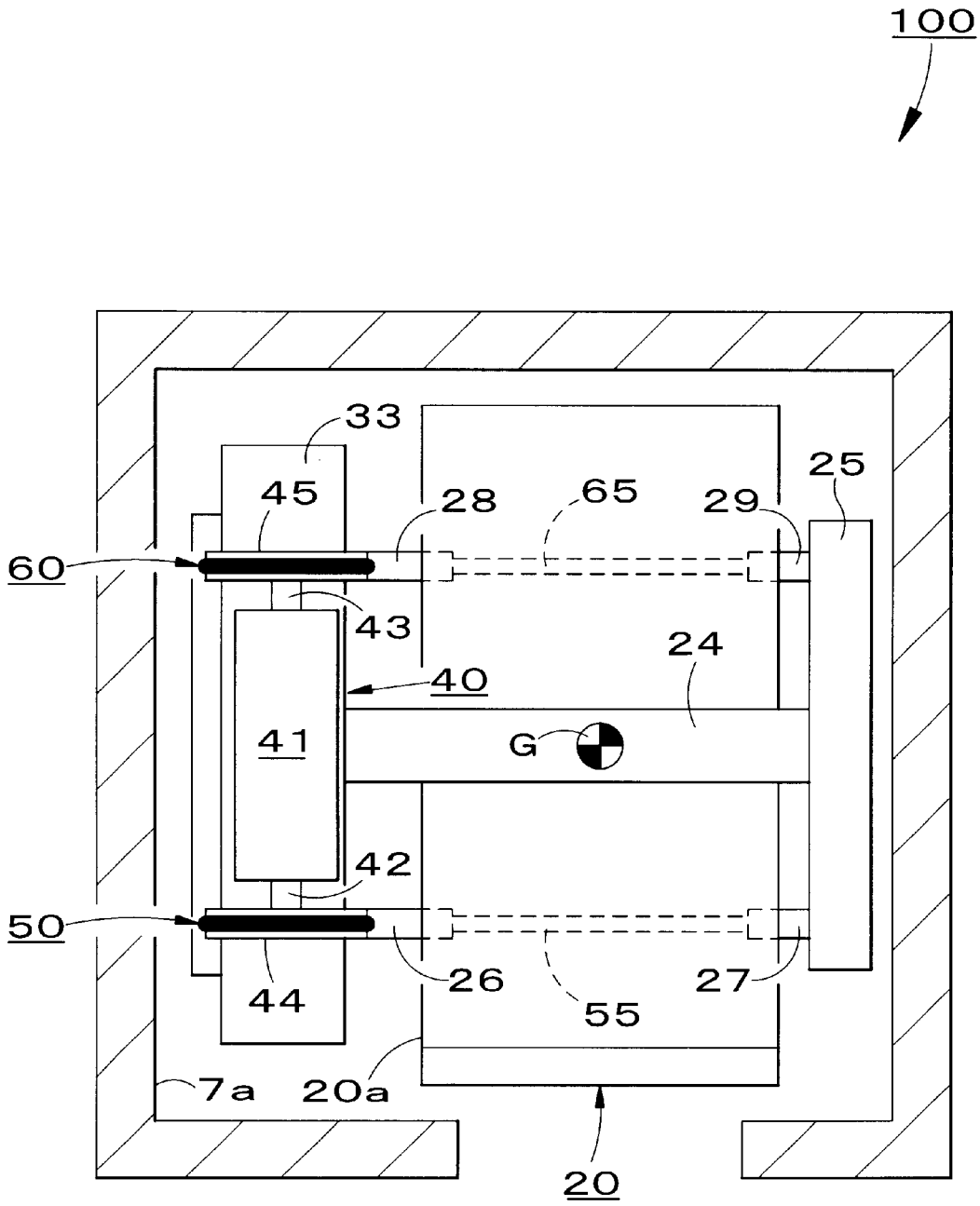
FIG. 4 is a plan view of the elevator shown in FIG. 1.

As shown in FIG. 4, the cage-side sheaves 26 to 29 are disposed symmetrically with respect to a vertical line passing the center G of gravity of the vacant cage 20, i.e., a design point on which the gravity is expected to act when the cage 20 is vacant.

A counterweight 30 is guided for vertical movement along a left side surface 7*a* of the elevator shaft 7 by counterweight guide rails 31 and 32. The counterweight guide rails 31 and 32 are disposed on the front and the backside, respectively, of the counterweight 30.

A horizontal connecting beam 33 has opposite ends joined to the upper ends of the counterweight guide rails 31 and 32.

The connecting beam 33 is parallel to the left sidewall of the cage 20. The connecting beam 33 has a middle part joined to the left cage guide rail 22. Thus, a load exerted on the connecting beam 33 is born by the left cage guide rail 22 and the counterweight guide rails 31 and 32. Two counterweight-side sheaves 34 and 35 are supported for rotation on brackets, not shown, attached to the upper end of the counterweight 30.

Two counterweight-side sheaves 34 and 35 are supported for rotation on brackets, not shown, attached to the upper end of the counterweight 30.

A driving unit 40 including a hoist 41 is fixedly mounted on the connecting beam 33. The hoist 41 has drive shafts 42 and 43 extending to the front and to the back, respectively. A front traction sheave 44 and a back traction sheaves 45 are fixedly mounted on the drive shafts 42 and 43, respectively.

As shown in FIGS. 1 to 4, the driving unit 40 is disposed so as to lie in a space between the left side surface 7*a* facing the counterweight 30 of the elevator shaft 7, and the left side wall 20*a* facing the left side surface 7*a* of the elevator shaft 7 of the cage 20 as located at its uppermost position in the elevator shaft 7; that is, the driving unit 40 is disposed at a level below that of the ceiling 20*b* of the cage 20 as located at the uppermost position in the elevator shaft 7.

The hoist 41 has an outside diameter smaller than those of the traction sheaves 44 and 45.

A front hoist cable 50 and a back hoist cable 60 are wound around the front traction sheave 44 and the back traction sheave 45, respectively.

As shown in FIG. 5, a segment 51 of the front hoist cable 50 extends between the front traction sheave 44 and the counterweight-side sheave 34, and a segment 61 of the back hoist cable 60 extends between the back traction sheave 45 and the counterweight-side sheave 35.

A segment 52 extending upward from the counterweight-side sheave 34 of the front hoist cable 50 has an anchoring end 53 hitched to the connecting beam 33 serving as a counterweight-side hitching device, and a segment 63 extending upward from the counterweight-side sheave 35 of the back hoist cable 60 has an anchoring end 63 hitched to the connecting beam 33.

Thus, the parts of the hoist cables 50 and 60 on the side of the counterweight 30 are extended in two-to-one roping arrangement to suspend the counterweight 30.

When the hoist cables 50 and 60 are extended in two-to-one roping arrangement to suspend the counterweight 30, the ratio of winding speed at which the traction sheaves 44 and 45 wind the segments 51 and 61 of the hoist cables 50 and 60 to the moving speed of the counterweight 30 is two to one.

As shown in FIG. 5, segments 54 and 64 of the hoist cables 50 and 60 extending from the traction sheaves 44 and 45 toward the cage 20 are wound around the cage-side sheaves 26 and 27, and the cage-side sheaves 28 and 29, respectively.

Parallel segments 55 and 65 of the hoist cables 50 and 60 extend horizontally between the cage-side sheaves 26 and 27 and between the cage-side sheaves 28 and 29, respectively.

Respective segments 56 and 66 of the hoist cables 50 and 60 respectively extending upward from the cage-side sheaves 27 and 29 have anchoring ends 57 and 67 hitched to the cage-side hitching beam 25, respectively.

Thus, the parts of the hoist cables 50 and 60 on the side of the cage 20 are extended in two-to-one roping arrangement to suspend the cage 20.

When the hoist cables 50 and 60 are extended in two-to-one roping arrangement to suspend the cage 20, the ratio of winding speed at which the traction sheaves 44 and 45 winds the segments 54 and 64 of the hoist cables 50 and 60 to the moving speed of the cage 20 is two to one.

The anchoring ends 57 and 67 on the side of the cage 20 of the hoist cables 50 and 60 are disposed symmetrically with respect to the right cage guide rail 23 on the front and the back side of the right cage guide rail 23, respectively.

Since the four cage-side sheaves 26 to 29 are disposed symmetrically with respect to a vertical line passing the center G of gravity of the vacant cage 20 as mentioned above, equal loads are exerted through the hoist cables 50 and 60 to the anchoring ends 57 and 67.

The operation of the elevator 100 embodying the present invention will be described hereinafter.

Figure 1:
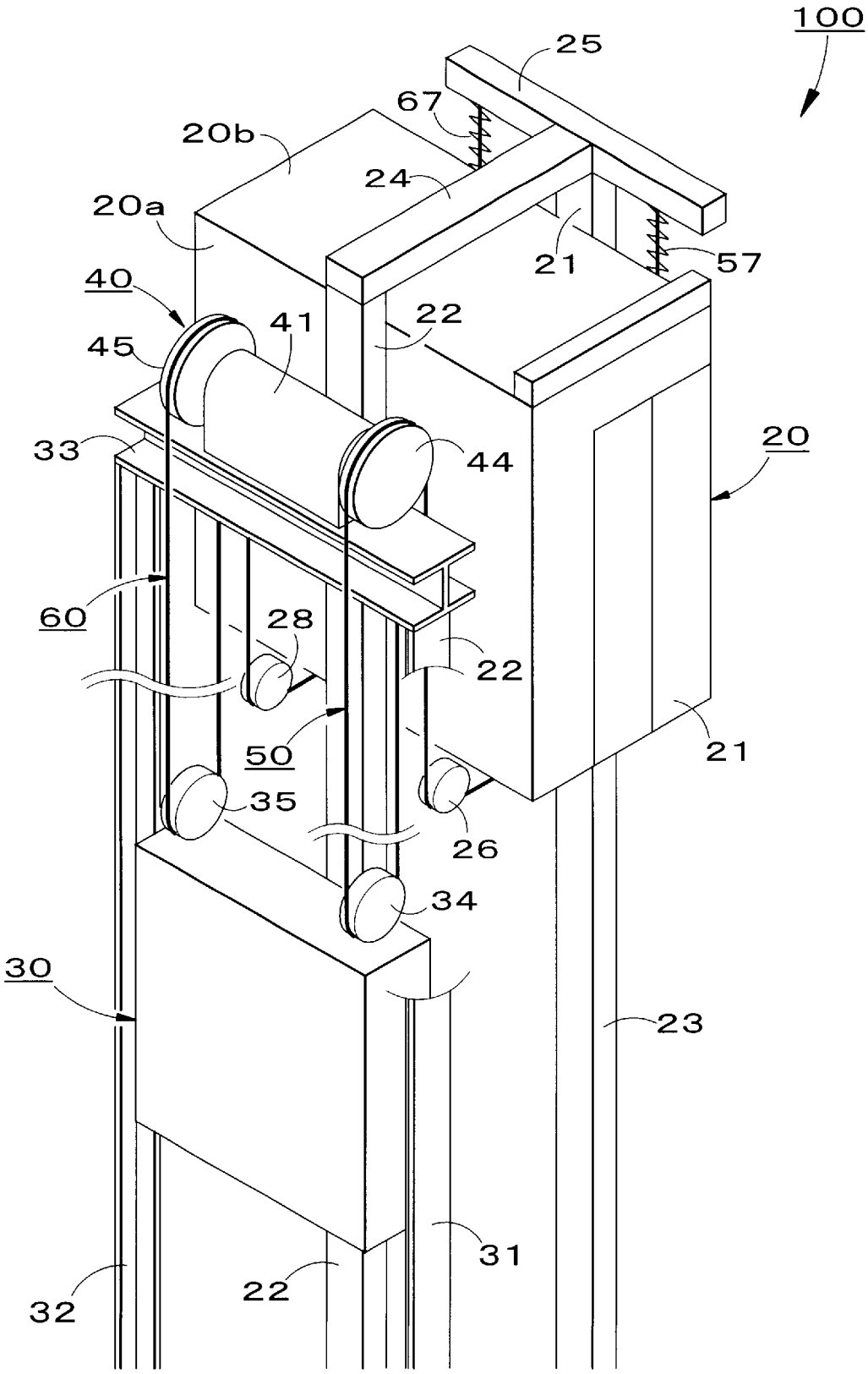
FIG. 1 is a perspective view of an elevator in a preferred embodiment according to the present invention.
Figure 2:
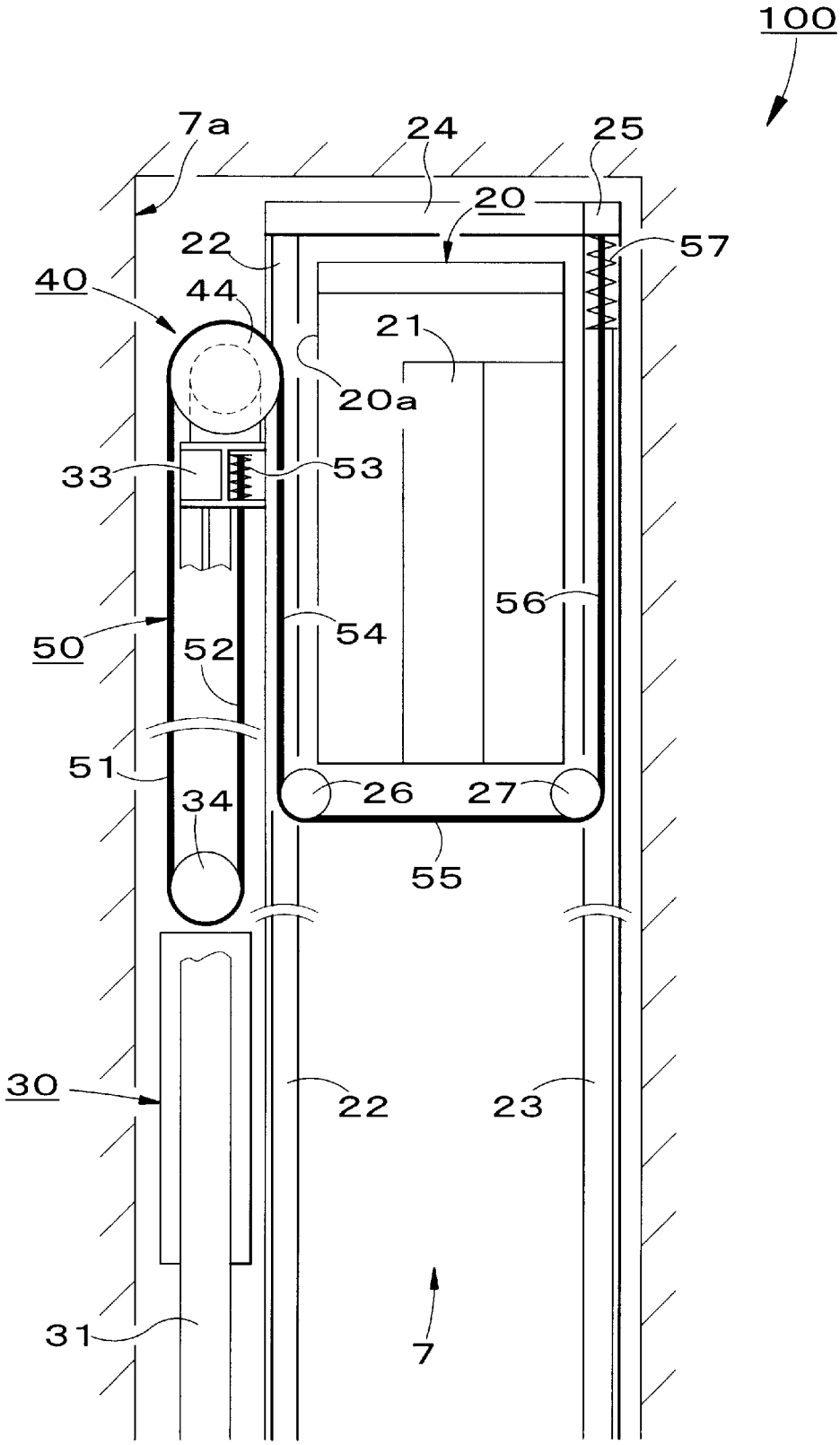
FIG. 2 is a front elevation of the elevator shown in FIG. 1.
Figure 3:
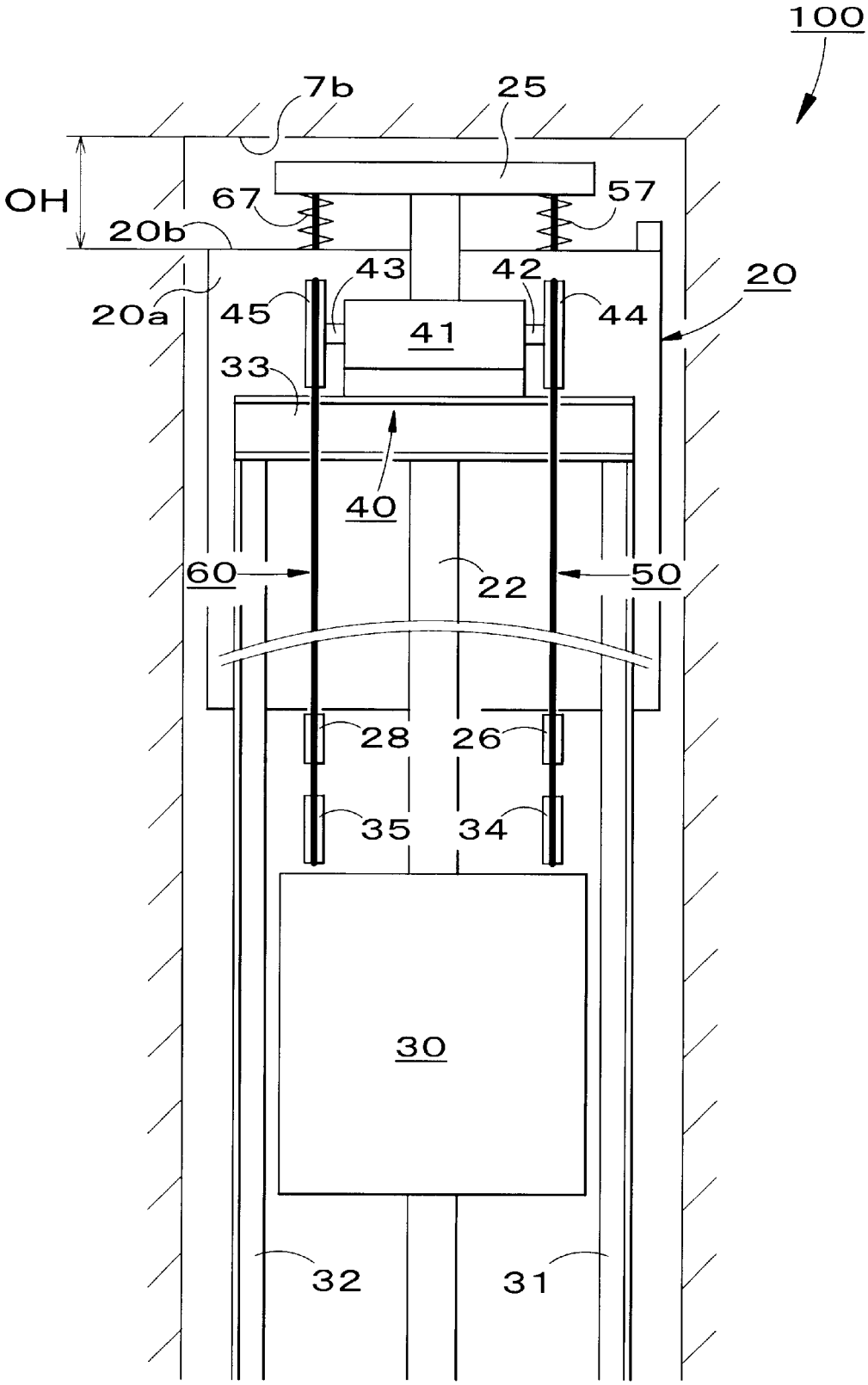
FIG. 3 is a side elevation of the elevator shown in FIG. 1.

Since the cage 20 and the counterweight 30 of the elevator 100 are suspended by the hoist cables 50 and 60 extended in two-to-one roping arrangement, the output torque of the driving unit 40, as compared with that of the driving unit of the prior art elevator 1 shown in FIG. 1, in which the hoist cables are extended in one-to-one roping arrangement, may be low.

Consequently, the driving unit 40 can be formed in small dimensions, the diameters of the traction sheaves 44 and 45 may be small and the hoist 41 may be of a short length. Therefore, he driving unit 40 can be supported on the upper ends of the weight guide rails 31 and 32 such that the traction sheaves 44 and 45 lie in the space between the left side surface 7*a* facing the counterweight 30 of the elevator shaft 7, and the left side surface 20*a* of the cage 20 facing the left side surface 7*a* of the elevator shaft 7 when the cage 20 is located at the uppermost position in the elevator shaft 7.

Thus, the driving unit 40 and the cage 20 is disposed outside a space in which the cage 20 moves vertically, and hence the vertical height "OH" (FIG. 3) of an top space between the ceiling 20*b* of the cage 20 as stopped at the uppermost position and the top surface 7*b* of the elevator shaft 7 may be small.

Since the cage 20 is suspended by the hoist cables 50 and 60 extended through the cage-side sheaves 26, 27, 28 and 29 disposed on the lower side of the floor of the cage 20 in two-to-one roping arrangement, the driving unit 40 can be disposed at a level below that of the ceiling 20*b* of the cage 20 as located at the uppermost position, which is effective in reducing the height OH of the top space of the elevator shaft 7.

The traction sheaves 44 and 45 of the elevator 100 can be disposed in the space between the left side surface 7*a* of the elevator shaft 7 and the left side surface 20*a* of the cage 20.

Therefore, the drive shafts 42 and 43 do not need to be elongated according to the size of the cage 20, and hence the driving unit 40 can be used in combination with various cages respectively having different dimensions.

Since the cage 20 of the elevator 100 embodying the present invention is suspended by the hoist cables 50 and 60 extended around the four cage-side sheaves 26, 27, 28 and 29 disposed symmetrically with respect to the vertical line passing the center G of gravity of the cage 20 on the lower surface of the floor of the cage 20, the line of action of a gravity acting on the cage 20 and that of a lifting force acting on the cage 20 are aligned substantially, and hence the cage 20 can be stably suspended.

In the elevator 100 embodying the present invention, the anchoring ends 57 and 67 of the hoist cables 50 and 60 are hitched to the cage-side hitching beam 25 at positions symmetrical with respect to the right cage guide rail 23 on the front and the back side of the right cage guide rail 23, respectively, and loads exerted through the hoist cables 50 and 60 on the cage-side hitching beam 25 are equal.

Therefore, bending moments exerted through the cage-side hitching beam 25 on the right cage guide rail 23 by the two hoist cables 50 and 60, respectively, offset each other and the right cage guide rail 23 can be prevented from bending.

In the elevator 100 embodying the present invention, loads exerted by the two hoist cables 50 and 60 and the driving unit 40 on the connecting beam 33 are born by the counterweight guide rails 31 and 32 and the left cage guide rail 22.

Therefore, the loads are distributed to the counterweight guide rails and the left cage guide rail 22, and hence the guide rails can be prevented from bending or buckling.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

For example, although the distance between the cage-side sheaves 26 and 28 on the left side of the cage 20 is equal to that between the cage-side sheaves 27 and 29 on the right side of the cage 20, and the segments 55 and 65 extending under the cage 20 of the hoist cables 50 and 60 are parallel to each other in the foregoing elevator 100, the distance between the cage-side sheaves 26 and 28 on the left side of the cage 20 may be different from that between the cage-side sheaves 27 and 29 on the right side of the cage 20, and the segments 55 and 65 extending under the cage 20 of the hoist cables 50 and 60 may be not parallel to each other, depending on the positional relation between the cage-side sheaves 26 and 28, and the counterweight-side sheaves 34 and 35 and the traction sheaves 44 and 45.

What is claimed is:

1. An elevator comprising:

a cage capable of vertically moving along cage guide rails in an elevator shaft, and provided with cage-side sheaves on its lower portion;

a counterweight capable of vertically moving along counterweight guide rails in the elevator shaft and provided with counterweight-side sheaves;

two hoist cables wound around the cage-side sheaves and the counterweight-side sheaves such that one end part of the hoist cables suspend the cage and the other end part of the same suspend the counterweight in two-to-one roping arrangement respectively; and a driving unit including traction sheaves around which the two hoist cables are wound respectively, and held on upper ends of the counterweight guide rails;

wherein, in a top plan view of the elevator shaft, the traction sheaves of the driving unit are disposed in a space between an inner side surface of the elevator shaft facing the counterweight and a vertical outer side surface of the cage facing the same inner side surface of the elevator shaft, when the cage exists at its uppermost position in the elevator shaft.

2. The elevator according to claim 1, wherein the cage-side sheaves are disposed at four positions on the lower portion of the cage respectively and symmetrically with respect to a center of gravity of the cage in a top plan view, and the two hoist cables are wound around the traction sheaves and are wound around a pair of the cage-side sheaves in two-to-one roping arrangement respectively to suspend the cage.

3. The elevator according to claim 2, wherein cage-side ends of the hoist cables are hitched to a cage-side hitching beam supported on one of the cage guide rails symmetrically disposed with respect to the cage guide rail.

4. The elevator according to any one of claims 1 to 3, wherein counterweight-side ends of the hoist cables are hitched to a counterweight-side hitching beam supported by the counterweight guide rails and a counterweight-side guide rail.

* * * * *